United States Patent [19]

Horn

[11] 4,009,517

[45] Mar. 1, 1977

[54] BARBERING TOOL

[76] Inventor: Robert E. Horn, 4866 Viento Drive, St. Louis, Mo. 63129

[22] Filed: Nov. 5, 1975

[21] Appl. No.: 629,025

Related U.S. Application Data

[62] Division of Ser. No. 351,422, April 16, 1973, Pat. No. 3,919,769.

[52] U.S. Cl. ..... 30/30

[51] Int. Cl.[2] ..... B26B 21/12

[58] Field of Search ..... 30/30, 31

[56] References Cited

UNITED STATES PATENTS

| | | | |
|---|---|---|---|
| 1,175,023 | 3/1916 | Szabo | 30/30 |
| 2,674,035 | 4/1954 | Doerr | 30/30 |
| 3,402,467 | 9/1968 | Manahan | 30/30 |
| 3,613,233 | 10/1971 | Lundell | 30/30 |

FOREIGN PATENTS OR APPLICATIONS

| | | | |
|---|---|---|---|
| 156,912 | 1/1921 | United Kingdom | 30/30 |

*Primary Examiner*—Al Lawrence Smith
*Assistant Examiner*—J. C. Peters
*Attorney, Agent, or Firm*—F. Travers Burgess

[57] ABSTRACT

A hair trimming tool comprising a dressing element such as a comb or brush, and a blade cutting element in which the elements extend alongside each other and may be adjusted relative to each other and are mounted on a handle which may be grasped by one hand of the user.

1 Claim, 5 Drawing Figures

BARBERING TOOL

This application is a division of my co-pending application Ser. No. 351,422, filed Apr. 16, 1973 now U.S. Pat. No. 3,919,769, issued Nov. 18, 1975.

BACKGROUND OF THE INVENTION

It is customary for a barber to manipulate a comb or brush in one hand and a razor or scissors in the other hand, particularly in effecting the so-called "styling trim" in which the skill of the user is a major factor in giving a satisfactory result. The present tool enables the user to more readily produce the desired result.

SUMMARY

The object of the invention is to simplify hair trimming particularly in effecting a razor cut or "styling" operation more readily than by use of separate comb or brush in one hand and a razor or scissors in the other hand.

DETAILED DESCRIPTION

Figure 1:
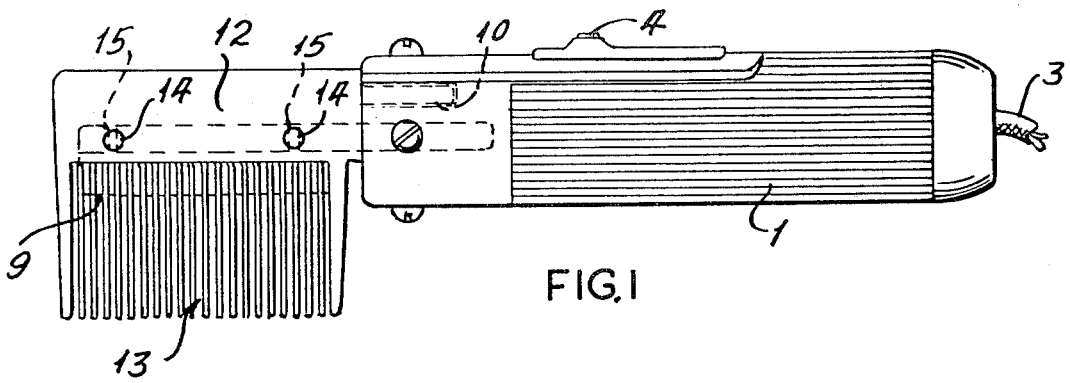
FIG. 1 is a side elevation of a motorized embodiment of the complete tool combining a comb and a straight razor blade in an electric actuated instrument.
Figure 2:
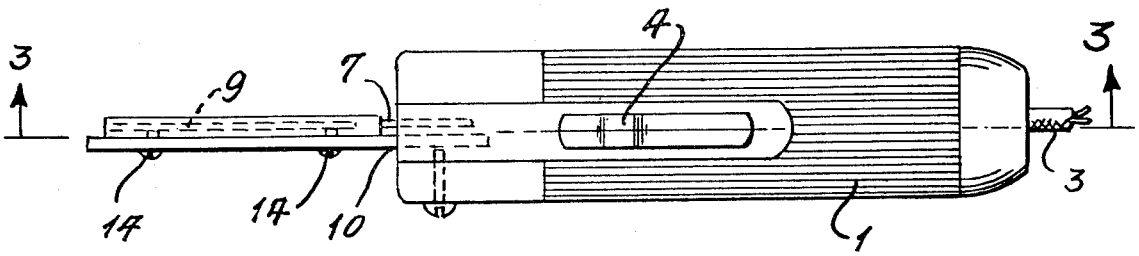
FIG. 2 is a top view of the same.
Figure 3:
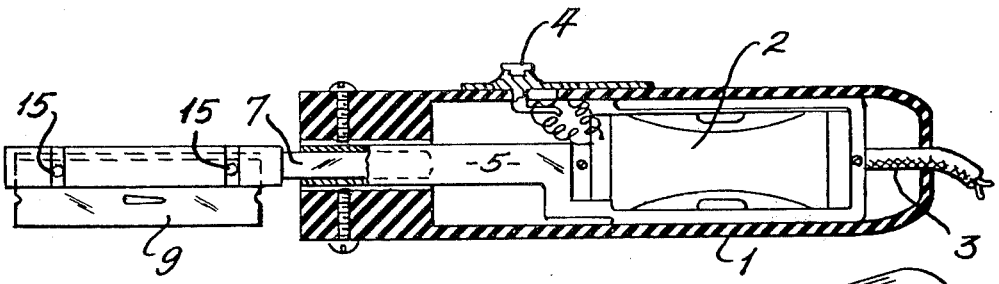
FIG. 3 is a longitudinal section on line 3—3 of FIG. 2.

The motorized form of the tool includes a handhold-casing 1 having an electric motor 2 with a supply cord 3 controlled by a button 4 on the casing and including a bar 5 which is reciprocated vertically of the casing when the circuit is closed and is provided with a slot receiving the end of a shank 7 having a grooved holder for a renewable blade 9. Casing 1 includes a recess for a shank 10 on a brush or comb which comprises a back 12 and teeth 13.

The comb and blade are disposed in substantially parallel relation with each other and may be adjusted toward and away from each other by loosening and tightening screws 14 in comb 12 which bear through slots 15 against blade 9 to thereby thrust the comb away from the blade. The comb and blade may be adjusted vertically relative to each other while being held against relative movement crosswise of the comb teeth by loosening screws 14 in slots 15 in the grooved holder portion of bar 5 which are elongated vertically, moving blade 9 vertically in the grooved holder to the desired adjusted position, and tightening screws 14.

Figure 4:
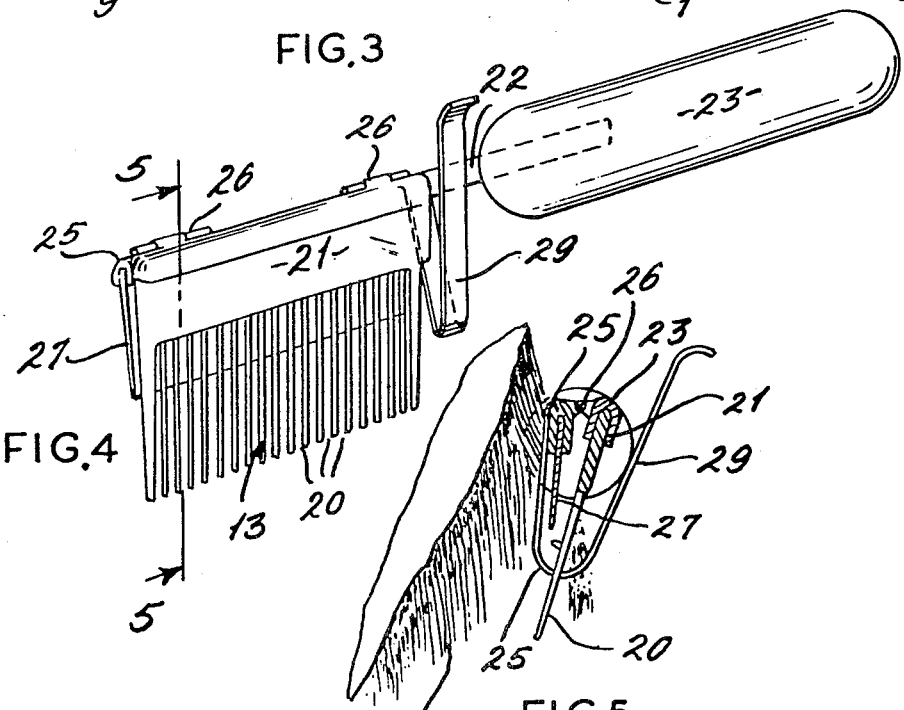
FIG. 4 is a perspective of an embodiment of the tool which does not include a motor.
Figure 5:
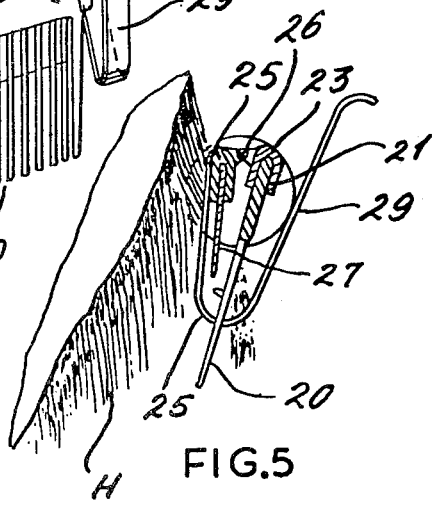
FIG. 5 is a section on line 5—5 of FIG. 4 and shows the application of the tool to a head of hair.

In the manual embodiment shown in FIGS. 4 and 5, the comb with teeth 20 has a back 21 with a shank 22 inserted in a socket in a plain handle 23. A blade holder 25 is hinged at 26 to the comb back 21 and mounts a blade 27 in an operating position substantially parallel to the comb. A finger piece 29 on the inner end of holder 25 is conveniently close to handle 23 and the blade and comb may be adjusted transversely of each other by light finger pressure on piece 29.

The user may draw the tool through hair H (FIG. 5) repeatedly to get the desired result without using two hands to hold separate comb and razor or shears.

In use, the comb teeth or brush bristles are inserted into the hair H (FIG. 5) on a person's head. The tool is drawn through the hair. During the tool stroke the razor blade and comb or brush are tilted and the hair may be "sliced" at an angle to its length to produce the desired "style" cut. Repeated strokes are readily made to vary the effect. The razor is drawn across the hair by hand or reciprocated as desired.

The tool will shave facial, axillary and leg hair with the comb acting as a guard. It will be understood that a person can use the tool on himself as a trimmer and blender as well as on another person. It blends, shapes and razor-cuts hair all at the same time.

The elements of the tool may be replaced separately which will expedite use of different sizes or types of elements. The tool is easily cleaned.

A corrugated blade may be substituted for the straight edge blade shown and the length of the comb relative to the blade varied. These and other details of the structure may be changed without affecting the principle of the combined tool and the exclusive use of those modifications coming within the scope of the appended claims is contemplated.

I claim:

1. A barbering tool comprising a cutting blade element and a comb element disposed in substantially parallel relation with each other, said comb element having teeth projecting beyond the cutting edge of said blade element, said blade and comb elements being held against movement lengthwise of said blade and lengthwise of said teeth with respect to each other, one of said elements having a shank extending parallel to the cutting edge, an elongated handle rigidly mounting said shank for simultaneous movement of both said blade and comb elements through a person's hair, and means for selectively varying the spacing of the cutting edge of said blade element from said comb element transversely of the plane of said blade element comprising hinge means along two adjacent edges of said comb and blade elements, and an elongated finger piece fixed to said blade element adjacent to said handle and extending transversely of said hinge means whereby to permit the user of the tool to adjust said blade element during use by finger pressure on a selected end portion of said finger piece without releasing his grip on said handle.

* * * * *